United States Patent [19]

Saito

[11] 4,053,181

[45] Oct. 11, 1977

[54] SEABED MINING UTILIZING CIRCULATING CURRENT BASED ON WATER LEVEL DIFFERENCES

[76] Inventor: Nakaji Saito, 3-1, Higashijujo 6-chome, Kita, Tokyo, Japan

[21] Appl. No.: 729,734

[22] Filed: Oct. 5, 1976

[30] Foreign Application Priority Data

Jan. 20, 1976 Japan ..... 51-5583

[51] Int. Cl.[2] ..... E02F 3/88

[52] U.S. Cl. ..... 299/9; 37/58; 37/66; 37/195; 37/DIG. 8; 417/61; 417/77

[58] Field of Search ..... 299/8, 9; 302/14; 37/58, 66, 61-63, DIG. 8, 195; 417/77, 61, 313

[56] References Cited

U.S. PATENT DOCUMENTS

| | | | |
|---|---|---|---|
| 1,461,240 | 7/1923 | Godfrey | 37/61 |
| 3,260,004 | 7/1966 | Brooks | 37/DIG. 8 |
| 3,620,572 | 11/1971 | Krutein | 299/8 |
| 3,693,272 | 9/1972 | Gariel | 302/14 X |
| 3,753,303 | 8/1973 | Holzenberger et al. | 302/14 X |
| 3,971,593 | 7/1976 | Porte et al. | 299/8 |

*Primary Examiner*—Clifford D. Crowder
*Attorney, Agent, or Firm*—William Anthony Drucker

[57] ABSTRACT

Apparatus for extracting mineral resources lying on the bottom of sea into a working ship floating on an ocean utilizing circulating current based on the difference of water levels. A hollow box shaped tank has its bottom opened and sunk liftably into the sea bottom through a rope from the working ship. The tank is equipped with a rotatory driving mechanism and trawled along the sea bottom while stirring it when the ship travels on the ocean. An elongated flexible coaxial pipe comprises an inner pipe and a coaxial outer pipe, each having at its lower end a fanwise shaped hopper mouth disposed within the tank through the upper wall thereof. The coaxial pipe passes through an internal seawater cistern in the bottom wall portion of the working ship and has its upper portion within an external seawater cistern mounted on the upper portion of the working ship. A suction pump is joined to the upper end of the coaxial inner pipe. Seawater contained in the internal cistern is continuously supplied through a line pump into the external cistern. Seawater and minerals contained in the tank are sucked into the external cistern through the coaxial inner pipe by the suction pump and the seawater is returned to the tank through the space defined by the outer wall of the coaxial inner pipe and the inner wall of the coaxial outer pipe utilizing the difference of levels between seawater within the external cistern and seawater within the internal cistern.

9 Claims, 5 Drawing Figures

SEABED MINING UTILIZING CIRCULATING CURRENT BASED ON WATER LEVEL DIFFERENCES

BACKGROUND OF THE INVENTION

The present invention relates to an apparatus and method for sucking and extracting seabed mineral resources such as manganolite into a working ship floating on an ocean utilizing circulating current based on the difference of water levels.

For example, it is well known to those skilled in the art that a considerably large amount of manganolite lies on the bottom of a specific open sea with the depth of about 1000 to 6000 meters.

It is therefore the object of the invention to provide apparatus and method for sucking and extracting with a high efficiency seabed mineral resources such as the above-mentioned manganolite into a working ship floating on an ocean utilizing circulating current based on the difference of water levels.

SUMMARY OF THE INVENTION

According to the invention, there is provided apparatus for sucking and extracting seabed mineral resources utilizing circulating current based on the difference of water levels comprising:

a working ship traveling on an ocean and mounted at its upper portion with an external cistern containing seawater;

a hollow box shaped tank having its bottom opened, sunk liftably into the sea bottom through a rope from said working ship, and having a rotatory driving mechanism for causing said tank to be trawled along the sea bottom while stirring it when said working ship travels on the ocean;

an elongated flexible coaxial pipe with both ends opened which includes an inner pipe and an outer pipe arranged coaxially with the inner pipe, the upper portion of which is disposed within the external cistern of said working ship, and which has a fanwise shaped hopper mouth at its lower end disposed within said tank through the upper wall thereof;

a suction pump joined within the external cistern to the upper end of said coaxial inner pipe;

selection means for selecting seabed mineral resources out of seawater sucked up by said pump from said tank through said coaxial inner pipe into the external cistern and gathering the selected mineral resources in said working ship; and returning means for bringing the seawater after selecting out the seabed mineral resources by said selection means back into said tank through a space defined by an outer wall of said coaxial inner pipe and an inner wall of said coaxial outer pipe utilizing the difference between the level of seawater contained in the external cistern and the level of seawater on the ocean.

Apparatus constructed as mentioned above can suck seawater containing mineral resources within the tank trawled along the sea bottom while stirring it in accordance with the movement of the working ship on the ocean into the external cistern mounted on the working ship through the coaxial inner pipe from the hopper mouth thereof by the action of the suction pump, then select only the desired mineral resources out of seawater sucked into the external cistern and extract into the working ship by said selection means, and thereafter bring only the remaining seawater back into the tank through the space defined by the outer wall of the coaxial inner pipe and the inner wall of the coaxial outer pipe utilizing the difference of levels between seawater within the external cistern and seawater on the ocean, thereby having the advantage of enabling mineral resources lying on the sea bottom to be sucked and extracted with the highest possible efficiency into the working ship through the coaxial pipe utilizing circulating current produced by the difference of the aforesaid seawater levels.

BRIEF DESCRIPTION OF THE DRAWINGS

The invention will be more fully understood by the detailed description taken in conjunctionwith the accompanying drawings, in which.

PREFERRED EMBODIMENT OF THE INVENTION

Figure 1:
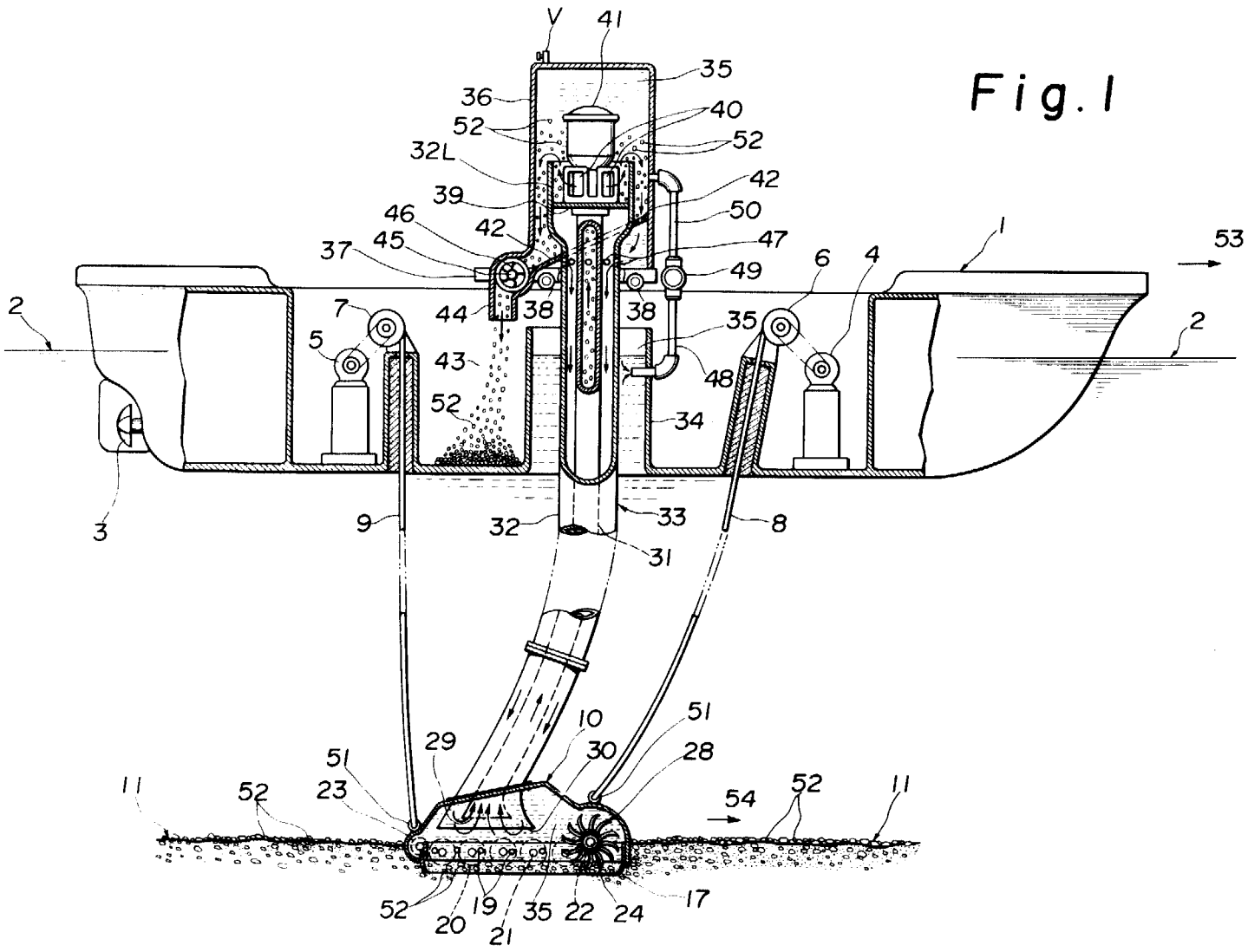
FIG. 1 is a schematic cross sectional view of apparatus for sucking and extracting seabed mineral resources utilizing circulating current based on the difference of water levels in accordance with the invention.

Referring to FIG. 1, reference numeral 1 denotes a working ship floating on an ocean 2 and traveling on the ocean 2 through the action of a screw propeller 3 mounted on the rear portion of the working ship 1.

Figure 2:
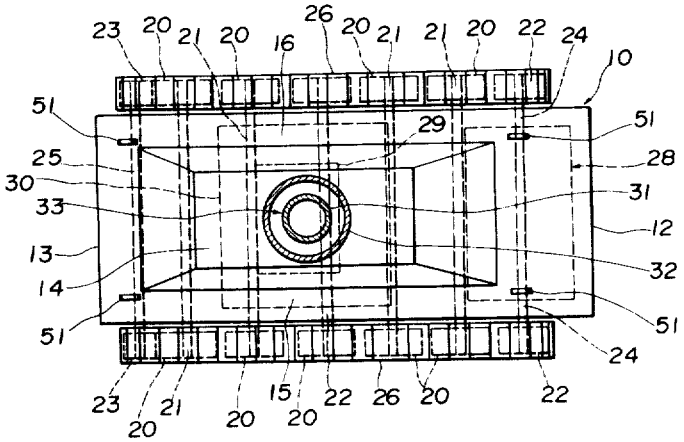
FIGS. 2 to 4 are enlarged top, side and cross sectional views of the tank shown in FIG. 1, respectively.
Figure 3:
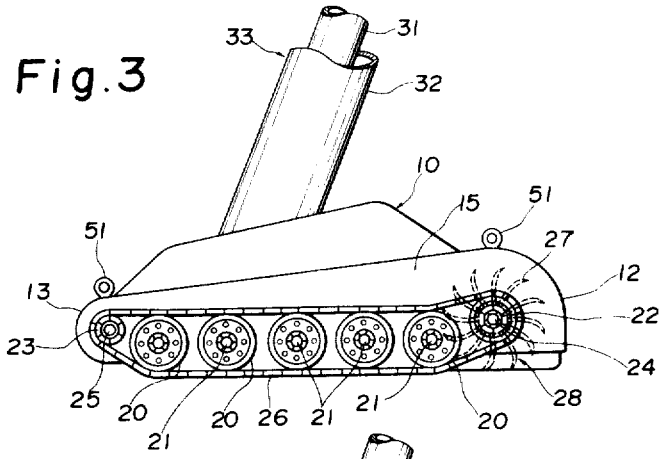
Figure 4:
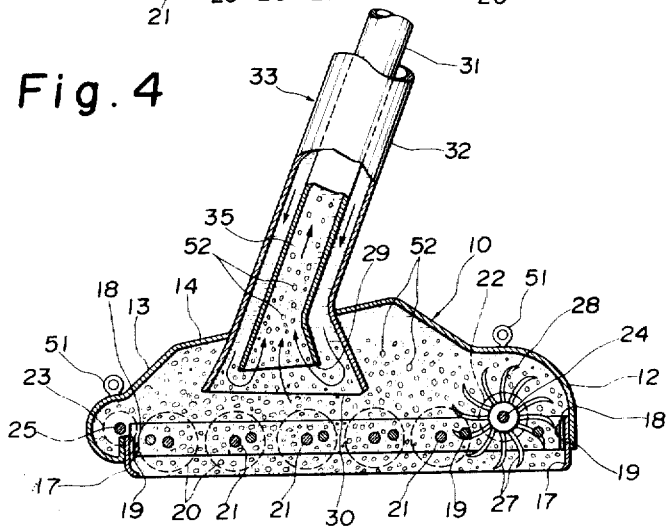
Figure 5:
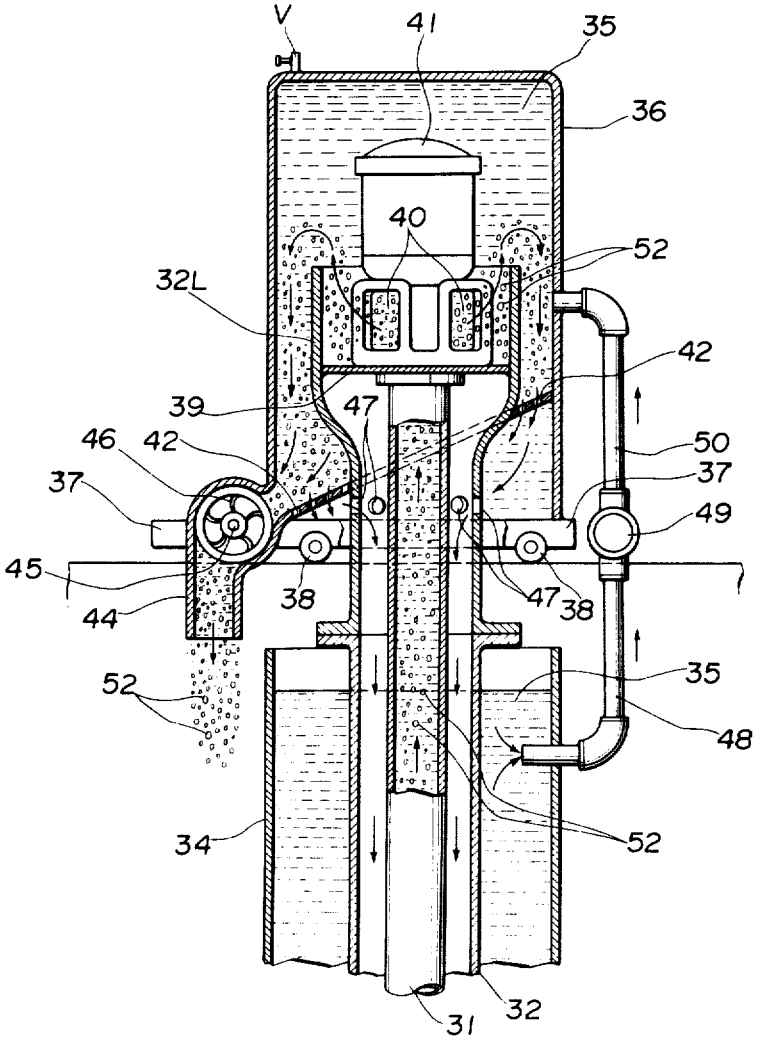
FIG. 5 is a cross sectional view of the internal and external seawater cisterns shown in FIG. 1.

A tank 10 of the hereinunder construction is adapted to be liftably sunk into the bottom 11 of sea through ropes 8 and 9 each having a large mechanical tensile strength and a good wearproof ability and wounnd on the corresponding winch 6 or 7 driven by the corresponding reversible motor 4 or 5 mounted on the ship 1. The tank 10 is made of a hollow box shaped metal plate formed as a whole in a streamlined configuration, and having a large corrosion resistance and its bottom opened. Namely, the tank 10 comprises, as best shown in FIGS. 2 to 4, a front plate 12, a back plate 13, an upper plate 14 joining between the upper ends of the front and back plates 13 and 12, and side plates 15 and 16 closing both sides of the front, back and upper plates 12, 13 and 14. A tongue like shaped watertight member 17 such as rubber having a large water-pressure resistance and good brittleness is so projected with its lower end contacted with the sea bottom 11 downward from the lower ends of the front, back and side plates 12, 13, 15 and 16 as watertightly to isolate seawater within the tank 10 from seawater existing outside thereof. The watertight member 17 has its upper portion secured through a stopper plate 18 to the lower inner (or outer) wall portion of each of the front, back and side plates 12, 13, 15 and 16 by means of bolts or screws 19.

On one hand, a plurality of (in this example, five) shafts 21 are rotatably supported at a substantially equal interval across the intermediate lower wall portions of both sides plates 15 and 16 of the tank 10, with their both ends which are projected outside of both side plates 15 and 16 and to which caterpillar wheels 20 are attached integrally therewith, the caterpillar wheels 20 having the same diameter and being free to rotate as hereinunder described along the sea bottom 11. Similarly, shafts 24 and 25 are rotatably supported across those front and rear lower wall portions of both side plates 15 and 16 which each have a slightly higher level than the aforesaid shafts 21, with their both ends which are projected outside of both side plates 15 and 16 and to which the foremost and rearmost caterpillar wheels 22 and 23 are fitted integrally therewith, the wheels 22 and 23 each having a slightly smaller diameter than that of each of the aforesaid wheels 21.

Thus, endless caterpillar belts 26 are wrapped over the whole corresponding caterpillar wheels 20, 22 and 23 situated at both outsides of both side plates 15 and 16. Further, a flexible agitation plumage 28 such as rubber is integrally attached on the peripheral wall of that intermediate portion of the foremost shaft 24 which is located within the tank 10, the agitation plumage 28 having a plurality of radially projected plumes 27 which act continuously to stir the sea bottom 11 when the tank 10 is trawled therealong as mentioned hereinafter.

On the other hand, there is provided a coaxial pipe 33 made of a appropriate flexible plastic material and comprising an inner pipe 31 and an outer pipe 32 which have fanwise hopper mouths 29 and 30 at their lower ends watertightly inserted through substantially the center of the upper plate 14 of the tank 10 thereinto.

Reverting again to FIG. 1, an internal seawater cistern 34 having both ends opened and a fully larger diameter than the coaxial pipe 33 is formed by causing the predetermined bottom wall portion of the working ship 1 to be vertically projected by the prescribed height. Further, an external seawater cistern 36 containing seawater 35 and having both ends closed and substantially the same dimension as the internal cistern 34 is mounted on that upper portion of the ship 1 which is situated almost just over the internal cistern 34. An air exhausting valve V is attached to the upper wall of the external cistern 36.

The external cistern 36 is arranged to be free to move along the aforesaid upper portion of the ship 1 by means of spaced rollers 38 fitted on its bottom plate 37. The upper end of the coaxial pipe 33 having its lower end installed within the tank 10 through the upper plate 14 thereof is disposed coaxially within the external cistern 36 through the center of the internal cistern 34 and through watertightly the center of the bottom plate 37 of the external cistern 36. In this case, the upper portion 32L of the coaxial outer pipe 32 is projected more upward by the given length than the upper end of the coaxial inner pipe 31 and formed to have an appropriately larger diameter than the remaining coaxial outer pipe portion. A suction pump 41 such as a submerged motor pump having plurality of drainage openings 40 is joined within the larger diametric coaxial outer pipe portion 32L to the upper end of the coaxial inner pipe 31 through a ring shaped petition plate 39. A ring shaped inclined strainer 42 such as a wire gauze having a mesh of an appropriate size is arranged between that outer peripheral wall portion of the coaxial outler pipe 32 which has a lower level than the drainage openings 40 of the suction pump 41 and the corresponding inner peripheral wall portion of the external cistern 36. A seabed mineral resource extracting guide pipe 44 as mentioned hereinafter is downward projected integrally with and from that lower wall portion of the external cistern 36 which faces the lower end of the inclined strainer 42 toward a seabed mineral resource gathering chamber 43 provided on the working ship 1.

A rotary valve 46 is so mounted within the gathering-chamber 43 as to be rotated around its axis in the clockwise or counter-clockwise direction. A plurality of seawater introducing holes 47 are perforated at a substantially equal interval in that peripheral wall portion of the coaxial outer pipe 32 which has a lower level than the strainer 42 within the external cistern 36. A line pump 49 is joined through a guide pipe 48 to that side wall portion of the internal cistern 34 which has a lower level than that of the ocean 2 and joined through a guide pipe 50 to that side wall portion of the external cistern 36 which has a higher level than the inclined strainer 42.

In FIGS. 1 to 4, reference numeral 51 denotes suspension rods provided on the four corners of the upper plate 14 of the tank 10, for the purpose of fixing each tip end of the ropes 8 and 9.

The operation of apparatus for sucking and extracting seabed mineral resources utilizing circulating current based on the difference of water levels in accordance with the invention will now be described.

When the working ship 1 has reached at a region of the ocean 2 just over that portion of the sea bottom 11 through the action of the screw propeller 3 on which a relatively large amount of desired mineral resources 52 such as manganolite lie, then the ship 1 is once stopped to travel along the ocean 2 by stopping the revolution of the screw propeller 3.

Under this condition, after fixing each tip end of the ropes 8 and 9 to the suspension rods 51, the operator causes the tank 10 with its bottom directed downward and its front plate 12 directed in the forward direction successively to sink toward the sea bottom 11 while unwinding the ropes 8 and 9 wound on the respective winches 6 and 7 by rotating the motors 4 and 5 in the predetermined direction. Thus, after the tank 10 is landed on the sea bottom 11 in the predetermined posture, the operator causes the working ship 1 to travel along the ocean 2 at a given speed in a desired direction as shown by an arrow 53 in FIG. 1 by driving again the screw propeller 3. As a result, the tank 10 is trawled along the sea bottom 11 at the same speed as and in the same direction, as shown by an arrow 54 in FIG. 1 as the working ship 1, as the caterpillar belts 26 are continuously revoluted at the predetermined speed in the clockwise direction by the action of the caterpillar wheels 20, 22 and 23 through the ropes 8 and 9 when the working ship 1 moves as mentioned above.

In this case, the tank 10 is trawled along the sea bottom 11 while continuously stirring it by the agitation plumage 28 attached around the foremost shaft 24, and seawater 35 contained in the tank 10 is watertightly isolated from sea water of the outside thereof by the tongue like shaped watertight member 17. For this reason, the mineral resources 52 being gathered and lying on the sea bottom 11 are mixed in the seawater 35 within the tank 10 after being stirred as mentioned above. When, therefore, the suction pump 41 arranged within the external cistern 36 mounted on the ship 1 is driven, then the seawater 35 within the tank 10 in which the seabed mineral resources 52 is mixed should be sucked up within the external cistern 36 through the coaxial inner pipe 31 from the hopper mouths 29 and 30 of the coaxial pipe 33, as shown by arrows in FIG. 1. The seawater which is sucked up within the external cistern 36 and in which the seabed mineral resources 52 is contained is then so jetted out of the drainage openings 40 of the suction pump 41 as to overflow from the upper end of the coaxial outer pipe 32, and thereafter dropped through the space defined by the outer peripheral wall of the coaxial outer pipe 32 and the opposite inner wall portion of the external cistern 36 on the inclined strainer 42. When, for this reason, the rotary valve 46 is driven, then only those of the seabed mineral resources 52 which have a larger size than that of the meshes of the inclined strainer 42 move therealong downward, and is then fallen and gathered into the gathering tank 43 mounted on the ship 1 from the guide pipe 44 through the rotary valve 46.

In this case, the operator previously causes the seawater 35 within the internal cistern 34 to be pumped up and filled in the external cistern 36 through the guide pipes 48 and 50 by driving the line pump 49, and causes seawater substantially equal amount to that pumped up into the external cistern 36 through the coaxial inner pipe 33 from the interior of the tank 10 by the suction pump 41 to be continuously pumped up from the internal cistern 34 into the external cistern 36 by the line pump 49, thereby enabling the seawater 35 out of which the seabed mineral resources 52 are selected by the strainer 42 to be brought, as shown by arrows in FIG. 1, back into the tank 10 through the space defined by the outer peripheral wall of the coaxial inner pipe 31 and the inner peripheral wall of the coaxial outer pipe 32 from the seawater introducing holes 47 bored around the predetermined peripheral wall portionof the coaxial outer pipe 32 utilizing the difference of levels between seawater within the external cistern 36 and seawater on the ocean 2 or within the internal cistern 34.

It should be noted that the coaxial pipe 33 generally requires a considerable length as well as its required length differs with the depth from the surface of ocean 2 to the sea bottom 11. For this reason, it is desired that the coaxial pipe 33 is practically divided into a plurality of units each having an appropriate length, and desired to attach only the uppermost unit with the larger diametric portion 32L and the lowermost unit with the hopper mouths 29 and 30 to the external cistern 36 and the tank 10 respectively, and desired to cause the remaining intermediate coaxial pipe units 33 to be serially joined by the number required in accordance with the depth from the ocean surface 2 to the sea bottom 11.

Apparatus constructed in accordance with the invention enables, as clear from the above, the mineral resources 52 lying on the sea bottom 11 to be continuously sucked and extracted into the working ship 1 through the coaxial pipe 33 arranged to produce circulating seawater current between the external cistern 36 mounted on the ship 1 and the interior of the tank 10, by causing the tank 10 sunk liftably into the sea bottom 11 through the ropes 8 and 9 from the ship 1 to be trawled along the sea bottom 11 while agitating it in accordance with the movement of the ship 1 along the ocean 2. Furthermore, as seawater within the tank 10 in which the seabed mineral resources 52 are mixed by the agitation is watertightly isolated from seawater of the outside of the tank 10 by the tongue like shaped watertight member 28, apparatus of the invention has the advantage of enabling the seabed mineral resources 52 to be sucked and extracted with the highest possible efficiency into the working ship 1.

It should be easily understood to those skilled in the art that the invention is not limited by only the abovementioned embodiment but is applicable to the variations and modifications covering the technical concept of the invention.

What is claimed is:

1. Apparatus for suckingg and extracting seabed mineral resources utilizing a circulating current based on the difference of water levels comprising:

a working ship traveling on an ocean and mounted at its upper portion with an external cistern containing seawater at a level higher than the level of seawater on the ocean;

a hollow box shaped tank having its bottom opened, sunk liftably into the sea bottom by a rope from said working ship, and having a rotatory driving mechanism for causing said tank to be trawled along the sea bottom while stirring it when said working ship travels on the ocean;

an elongated flexible coaxial pipe with both ends opened which includes an inner pipe and an outer pipe arranged coaxially with the inner pipe, the upper portion of which is disposed within the external cistern of said working ship, and which has an enlarged hopper mouth at its lower end disposed within said tank through the upper wall thereof;

a suction pump joined within the external cistern to the upper end of said coaxial inner pipe for sucking mineral resources and seawater from within said tank;

selection means for selecting seabed mineral resources out of seawater sucked up by said pump from said tank through said coaxial inner pipe into the external cistern and gathering the selected mineral resources in said working ship; and returning means for bringing the seawater after selecting out the seabed mineral resources by said selection means back into said tank through a space defined by an outer wall of said coaxial inner pipe and an inner wall of said coaxial outer pipe utilizing the difference between the level of seawater contained in the external cistern and the level of seawater on the ocean.

2. Apparatus claimed in claim 1, wherein the bottom wall portion of said working ship is so projected upwardly by a predetermined height as to form an internal cistern in which seawater is contained and through the center of which said coaxial pipe is passed, and wherein a line pump is so joined between said internal cistern and the external cistern as continuously to pump seawater contained in said internal cistern into the external cistern.

3. Apparatus claimed in claim 1, wherein the rotatory driving mechanism of said tank comprises a caterpillar driving mechanism to the rotary shaft of which a stirring blade for stirring the sea bottom is attached.

4. Apparatus claimed in claim 1, wherein a tongue like watertight member is so projected from the circumferential edge of the opened bottom of said tank that its lower end contacts with the sea bottom surface, thereby substantially to isolate seawater within said tank with seawater therewithout.

5. Apparatus claimed in claim 1, wherein said coaxial pipe is divided into a plurality of unit lengths joinable to each other.

6. Apparatus claimed in claim 1, wherein said selection means comprises an inclined strainer having a predetermined mesh and secured around the outer wall of said coaxial outer pipe, and a rotary valve mounted within a seabed mineral resource guide pipe projected downwardly from that lower side wall portion of the external cistern which faces the inclined lower end of said strainer toward a seabed mineral resource gathering chamber provided on said working ship.

7. Apparatus claimed in claim 1, wherein said returning means includes a plurality of openings so bored at a predetermined interval at that predetermined peripheral wall of said coaxial outer pipe which is disposed within the external cistern that seawater after selecting out the seabed mineral resources by said selection means is introduced into the space between said coaxial inner and outer pipes.

8. Apparatus claimed in claim 1, wherein said external cistern has at its bottom rollers enabling it appropriately to move along the mounting surface thereof on said working ship.

9. Method for sucking and extracting seabed mineral resources utilizing a circulating current based on the difference of water levels comprising:

a. a first step for sinking liftably a hollow box shaped tank with its bottom opened into the bottom of the sea by a rope from a working ship on the upper portion of which an external cistern containing seawater at a level above sealevel is mounted and which travels on an ocean;

b. a second step of trawling said tank after being landed on the sea bottom in a predetermined posture by said first step along the sea bottom while stirring it;

c. a third step for sucking up seawater within said tank in which seabed mineral resources are mixed by the stirring of said second step into said external cistern through the inner pipe of an elongated flexible coaxial pipe which includes an inner pipe and an outer pipe arranged coaxially with the inner pipe having its upper portion located within said external cistern and having a hopper mouth at its lower end inserted through the upper wall of said tank thereinto;

d. a fourth step for selecting the seabed mineral resources out of the seawater sucked up by said third step; and e. a fifth step of forcing the seawater out of which the mineral resources are selected by said fourth step back into said tank through a space between said inner pipe and said outer pipe of said coaxial pipe utilizing the difference of levels between seawater within said external cistern and seawater on the surface of the ocean.

* * * * *